US009598231B2

(12) United States Patent
Kamerbeek

(10) Patent No.: US 9,598,231 B2
(45) Date of Patent: Mar. 21, 2017

(54) CUP-SHAPED BODY FOR A CAPSULE FOR PREPARING A BEVERAGE

(71) Applicant: Koninklijke Douwe Egberts B.V., Utrecht (NL)

(72) Inventor: Ralf Kamerbeek, Utrecht (NL)

(73) Assignee: Koninklijke Douwe Egberts B.V., Utrecht (NL)

( * ) Notice: Subject to any disclaimer, the term of this patent is extended or adjusted under 35 U.S.C. 154(b) by 0 days.

(21) Appl. No.: 14/456,426

(22) Filed: Aug. 11, 2014

(65) Prior Publication Data

US 2015/0086680 A1 Mar. 26, 2015

Related U.S. Application Data

(63) Continuation of application No. PCT/NL2013/050083, filed on Feb. 13, 2013.

(30) Foreign Application Priority Data

Feb. 13, 2012 (NL) ..... 2008281

(51) Int. Cl.
*B65D 85/804* (2006.01)
*B65D 21/02* (2006.01)
*A47G 19/23* (2006.01)

(52) U.S. Cl.
CPC ..... *B65D 85/8043* (2013.01); *A47G 19/23* (2013.01); *B65D 21/0233* (2013.01)

(58) Field of Classification Search
CPC B65D 1/265; B65D 21/0233; B65D 85/8043; A47G 19/23
USPC ..... 206/503, 507, 509, 515, 520, 219, 516; 220/608
See application file for complete search history.

(56) References Cited

U.S. PATENT DOCUMENTS 3,784,052 A * 1/1974 Edwards ..... B65D 1/265 206/520
5,419,436 A * 5/1995 Powell ..... A47G 19/2205 206/217
6,213,301 B1 * 4/2001 Landis ..... B65D 3/12 206/519

(Continued)

FOREIGN PATENT DOCUMENTS

WO WO2004/065258 8/2004
WO WO-2012/019902 2/2012
WO WO-2012/019903 2/2012

OTHER PUBLICATIONS

International Search Report for International Application No. PCT/NL2013/050083, dated May 21, 2013, 2 pages.

*Primary Examiner* — Jeffrey Allen
*Assistant Examiner* — Jennifer Castriotta
(74) *Attorney, Agent, or Firm* — Foley & Lardner LLP

(57) ABSTRACT

A cup-shaped body comprises a circumferential wall and a first end wall. The first end wall comprises a deepened portion, forming a first recessed space. The first end wall further comprises a projection protruding from said deepened portion into said first recessed space. The body is formed such that identical specimens of the body are slidable into one another. The deepened portion is formed to comprise abutment structure having an abutment condition in which the extent of said slidability of a first one of said specimens into a second one of said specimens is limited.

15 Claims, 7 Drawing Sheets

(56) References Cited

U.S. PATENT DOCUMENTS

| | | | | |
|---|---|---|---|---|
| 2006/0021986 | A1* | 2/2006 | Mansfield | A47G 19/2205 220/506 |
| 2007/0199940 | A1* | 8/2007 | Skala | A47G 19/2205 220/506 |
| 2009/0205504 | A1 | 8/2009 | Navarro Alcantara | |
| 2010/0294774 | A1 | 11/2010 | Mansfield et al. | |
| 2013/0221009 | A1* | 8/2013 | Zimmer | A47G 19/2205 220/359.1 |

* cited by examiner

CUP-SHAPED BODY FOR A CAPSULE FOR PREPARING A BEVERAGE

CROSS-REFERENCE TO RELATED PATENT APPLICATIONS

This Application is a continuation of International Patent Application No. PCT/NL2013/050083, filed on Feb. 13, 2013, which claims the benefit of priority to Netherlands Application No. 2008281, filed on Feb. 13, 2012, all of which are hereby incorporated herein by reference in their entireties.

BACKGROUND

The invention relates to a cup-shaped body for a capsule, the capsule containing an extractable product and being arranged for preparing a consumable beverage in a beverage preparation device.

Such a cup-shaped body and such a capsule are described in international patent application with application number PCT/EP2011/062738 and with title "Device, system and method for preparing a beverage from a capsule". More in particular, is can be derived from PCT/EP2011/062738 that it describes a cup-shaped body comprising:

a circumferential wall around a reference axis, a first end wall closing the circumferential wall at a first end of the cup-shaped body, and an open second end, opposite the first end, allowing for filling the cup-shaped body through said open second end with said extractable product so as to form said capsule when the thus filled cup-shaped body is closed with a second end wall at said open second end;

wherein:

for reference purposes in relation to the cup-shaped body, a first direction along said reference axis is defined as being directed from the first end towards the open second end, and a second direction along said reference axis is defined as being opposite to the first direction, the first end wall comprises a portion being deepened in the first direction, said deepened portion thus forming a first recessed space on the second direction side of the first end wall, and the first end wall comprises a projection protruding from said deepened portion into said first recessed space.

In PCT/EP2011/062738 said projection of said first end wall of said cup-shaped body functions as an actuating member of the capsule formed with the cup-shaped body, which actuating member is engageable with a switching member of a flow control unit of the beverage preparation device. PCT/EP2011/062738 describes various uses of said engagement between said projection and said beverage preparation device. Such a device is also described in PCT/EP2011/062740.

For a good understanding of the present invention, such uses of said engagement between said projection and said beverage preparation device are not of particular relevance and are therefore not described in detail herein. Instead, the present invention substantially relates to the particular cup-shaped body whose first end wall comprises said deepened portion and said projection in the way as recited above.

In the production process of the capsules, each time an individual cup-shaped body is filled with said extractable product and a capsule is formed by closing the thus filled cup-shaped body with a second end wall at said open second end of the cup-shaped body. Clearly, huge numbers of capsules are being processed and consequently huge numbers of cup-shaped bodies have to be provided. Therefore, it is desirable that the huge numbers of cup-shaped bodies are compactly stackable relative to one another, for purposes of storage, transport, and various other operations with the cup-shaped body, such as supplying the cup-shaped bodies to filling equipment for filling them with extractable product.

It is an object of the invention to provide a solution according to which cup-shaped bodies whose first end walls comprise said deepened portions and said projections, in the way as recited above, are stacked compactly and reliably.

For that purpose, the invention provides a cup-shaped body for a capsule, the capsule containing an extractable product and being arranged for preparing a consumable beverage in a beverage preparation device, the cup-shaped body comprising:

a circumferential wall around a reference axis, a first end wall closing the circumferential wall at a first end of the cup-shaped body, and an open second end, opposite the first end, allowing for filling the cup-shaped body through said open second end with said extractable product so as to form said capsule when the thus filled cup-shaped body is closed with a second end wall at said open second end;

wherein:

for reference purposes in relation to the cup-shaped body, a first direction along said reference axis is defined as being directed from the first end towards the open second end, and a second direction along said reference axis is defined as being opposite to the first direction, the first end wall comprises a portion being deepened in the first direction, said deepened portion thus forming a first recessed space on the second direction side of the first end wall, the first end wall comprises a projection protruding from said deepened portion into said first recessed space, the cup-shaped body is formed such that identical specimens of the cup-shaped body are slidable, along said reference axis, into one another so as to form a stack of said specimens, said slidability being such that a first specimen of said specimens can be slided in the second direction and with its first end in front through the open second end of a second specimen of said specimens and into said second specimen, and the deepened portion of the first end wall is formed to comprise abutment structure having an abutment condition in which the extent of said slidability of said first specimen into said second specimen is limited by abutment of said abutment structure of said second specimen with the first end wall of said first specimen.

Thanks to said slidability and the above recited abutment structure of the deepened portion of the first end wall it is possible to form a stack of (huge numbers of) identical specimens of the cup-shaped body.

In a preferable embodiment it is prevented in said abutment condition that said projection of said first specimen touches said second specimen, even in case said projection protrudes in the second direction as far as the farthermost point of the first end wall of said first specimen.

This way it is prevented that due to the stacking the projections would deform or break. Also it is prevented that for example the deepened portions would deform or break due to pushing contacts between projections and deepened portions, which pushing contacts might easily occur by way of chain reaction throughout the whole stack.

In another preferable embodiment said projection touches the second specimen in said abutment condition. Said touching may for example be in a bearing manner, in which case said projection functions as part of the abutment structure.

However, in another preferable embodiment, said projection just touches the second specimen without bearing said second specimen in said abutment condition.

Preferably, said abutment structure comprises at least one rib providing said abutment, the at least one rib being situated on that side of said deepened portion of the first end wall that faces away from said first recessed space. Such at least one rib may be of various types, such as a rib which extends circumferentially around the reference axis, e.g. a rib in the form of a flange. Alternatively or additionally it is advantageous to apply at least one such rib having a longitudinal rib direction whose component projected along the reference axis is as large as possible. The last mentioned rib provides high resistance of the cup-shaped bodies in a stack against forces occurring within the stack parallel to the reference axis.

In another preferable embodiment, said abutment structure comprises at least one second rib providing said abutment, the at least one second rib being situated on that side of said deepened portion of the first end wall that faces towards said first recessed space.

In a further, preferable embodiment of the invention the deepened portion of the first end wall comprises a protruding part protruding into the first direction in such manner that the protruding part of the second specimen in said abutment condition protrudes into the first recessed space of the first specimen. Such a protruding part promotes accurate in-line placement of adjacent cup-shaped bodies being in said abutment condition within the stack.

Preferably, the cup-shaped body is further arranged such that in said abutment condition the minimum radial distance between said protruding part of the second specimen and the deepened portion of the first end wall of the first specimen decreases when measuring said minimum radial distance farther in the second direction along the reference axis, said minimum radial distance at a considered location along the reference axis being defined as taken in radial direction relative to the reference axis. Such a decreasing minimum radial distance promotes ease of bringing the protruding part of the second specimen into the first recessed space of the first specimen. Thanks to this decreasing minimum radial distance the abovementioned accurate in-line placement of adjacent cup-shaped bodies in said abutment condition is achieved automatically when the two specimens are being slided into each other.

Preferably, the protruding part is partly deepened in the second direction, thus forming a second recessed space on the first direction side of the protruding part in such manner that the projection of the first specimen in said abutment condition protrudes into the second recessed space of the second specimen. This allows for applying projections which are protruding relatively far in the second direction.

In a further, preferable embodiment of the invention the cup-shaped body is further arranged such that in said abutment condition of said abutment structure there also is abutment between the circumferential wall of said first specimen and the circumferential wall of said second specimen, said abutment of said circumferential walls being effective:

farther in the first direction than where the abutment of said abutment structure is effective, most preferably as far as possible away from where the abutment of said abutment structure is effective, and in at least three locations being angularly spaced relative to one another in circumferential direction around the reference axis, said angular spacing being such that in each of three complementary 120 degrees circumferential sectors around the reference axis there exists at least one of said at least three locations. Said additional abutment, i.e. the abutment of said circumferential walls, being effective farther in the second direction than where the abutment of said abutment structure is effective, promotes a stable in-line placement of adjacent cup-shaped bodies being in said abutment condition within the stack. Thereby, bending movements, especially of very long stacks consisting of large numbers of stacked cup-shaped bodies are restricted.

In a further, preferable embodiment of the invention, said abutment structure comprises a rilled surface of said deepened portion, said rilled surface providing said abutment. Such a rilled surface may be of various types. At least one rill of such a rilled surface may for example extend circumferentially around the reference axis. Alternatively or additionally it is advantageous to apply at least one such rill having a longitudinal rill direction whose component projected along the reference axis is as large as possible. The last mentioned rill provides high resistance of the cup-shaped bodies in a stack against forces occurring within the stack parallel to the reference axis.

These and other aspects of the invention will be apparent from and elucidated with reference to the embodiments described hereinafter by way of non-limiting examples only and with reference to the schematic figures in the enclosed drawing.

DETAILED DESCRIPTION

Figure 1:
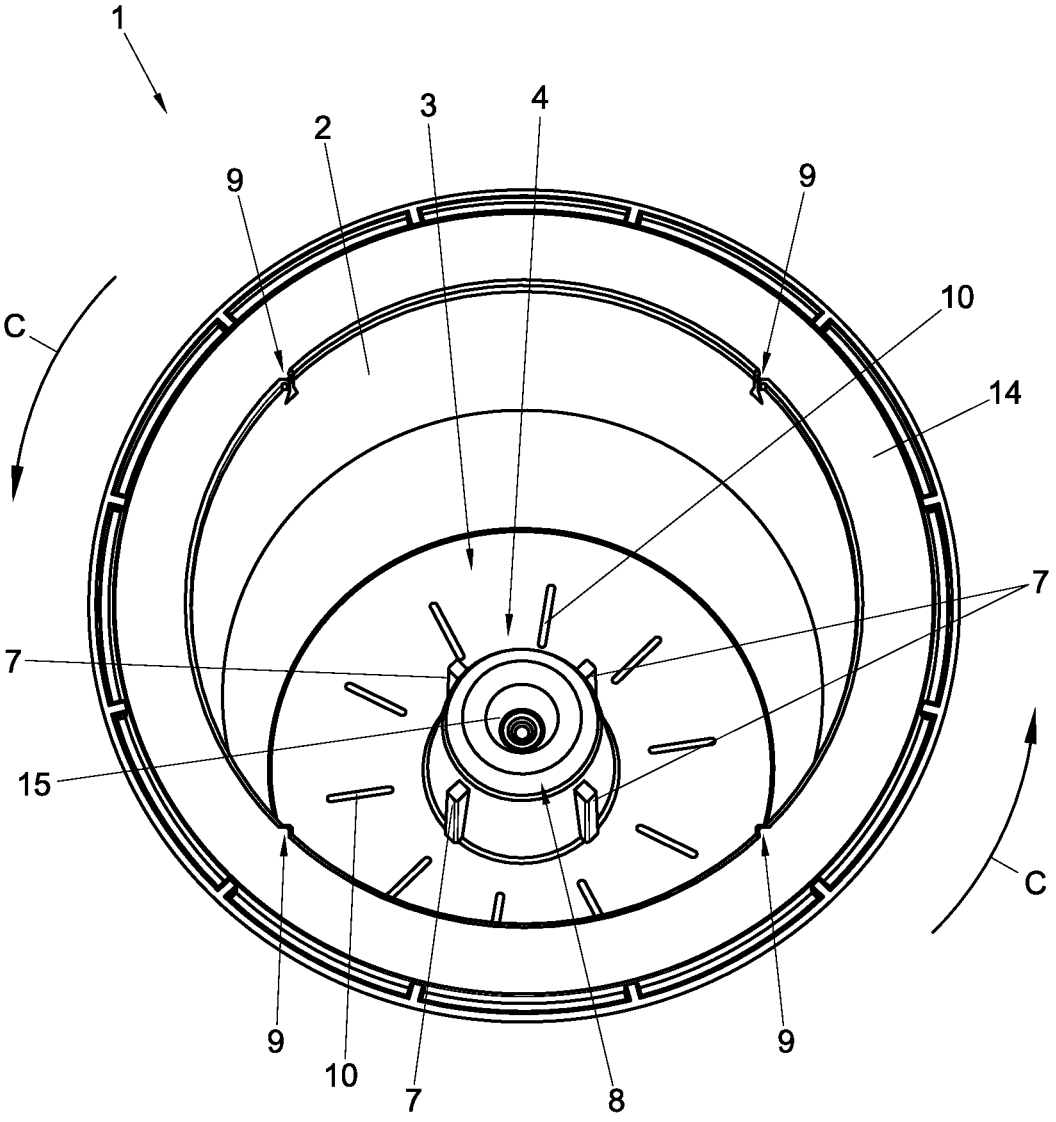
FIG. 1 shows, in a perspective view, a first specimen of a first embodiment of a cup-shaped body according to the invention.
Figure 2:
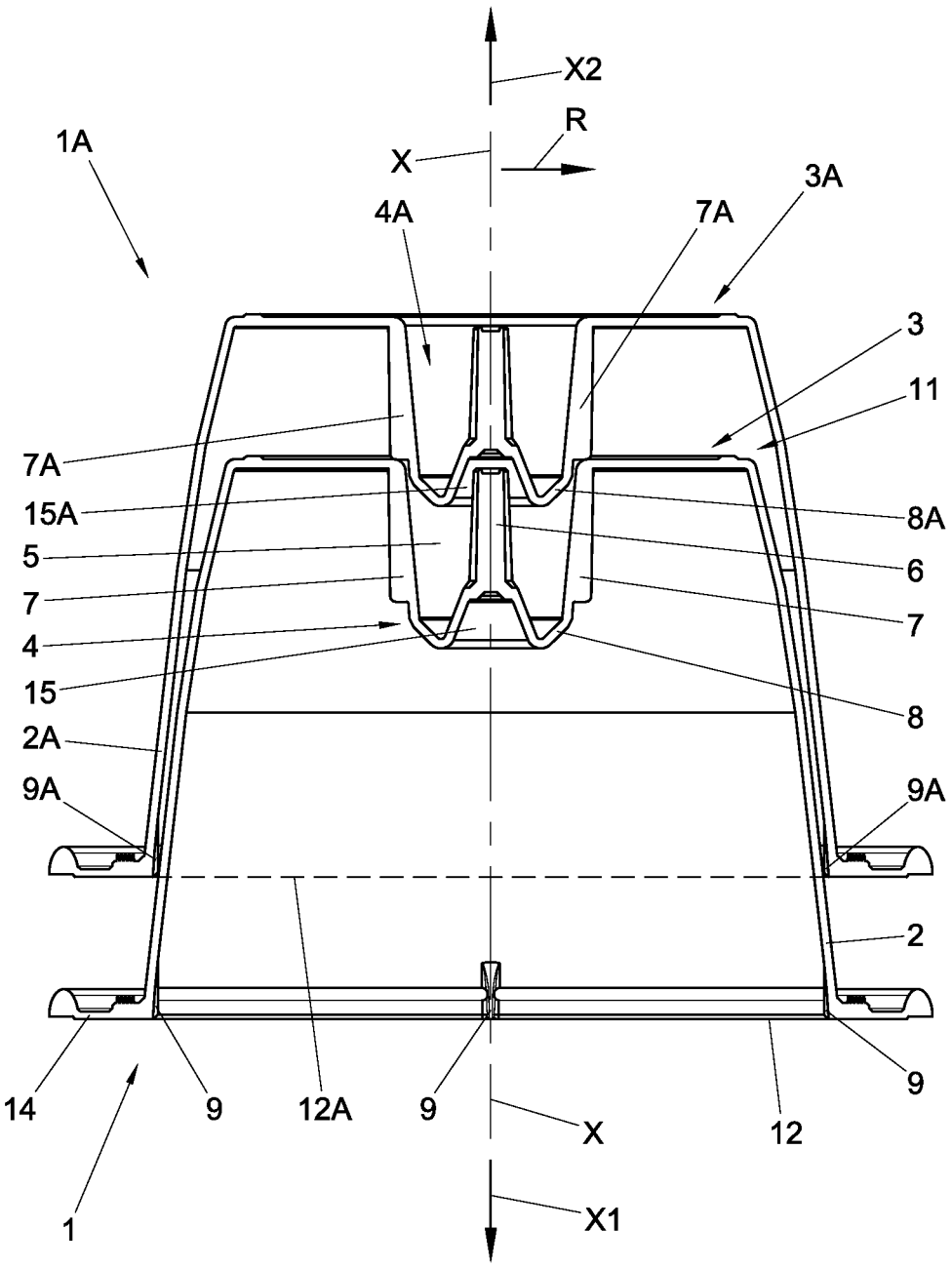
FIG. 2 shows the first specimen of FIG. 1 again, however this time in a cross-section (partly in through-view) and together with a second specimen being identical to the first specimen of FIG. 1, wherein the first specimen has been slided into the second specimen.

Reference is first made to the first embodiment of FIGS. 1 and 2, which show a first specimen 1 and a second specimen 1A of that first embodiment. Specimen 1A is identical to specimen 1. Hereinafter, specimen 1 and specimen 1A are also referred to as "body 1" and "body 1A", respectively. Identical parts of body 1 and body 1A are indicated by identical reference numerals, be it that to each reference numeral of body 1A the suffix "A" has been appended.

Body 1 comprises a circumferential wall 2 around a reference axis X, a first end wall 3 closing the circumferential wall at a first end 11 of body 1, and an open second end 12, opposite the first end 11. The open second end 12 allows for filling the body with an extractable product so as to form a capsule for preparing a beverage when the thus filled body is closed with a second end wall (not shown) at said open second end 12.

As an aside, it is remarked here that, in use of the capsule, the first end wall 3 is arranged for allowing a liquid, such as hot water, to enter the capsule for interacting with the extractable product contained within the capsule. In the shown example, the first end wall 3 is provided with a number of openings, in this case slits 10 (see FIG. 1), for allowing the liquid to enter the capsule. It will be appreciated that the first end wall 3 may also be porous. Alternatively, the first end wall 3 may be fluid tight, e.g. in case the beverage preparation device is arranged for opening, such as by piercing, the first end wall 3 for allowing the liquid to enter the capsule. Similarly, the second end wall (not shown) at said open second end 12 of the capsule will be arranged for allowing the beverage and/or liquid to exit the capsule, e.g. after interaction with the extractable product. In this example, such a second end wall may be connected to the outwardly extending flange-like rim 14 shown at the open second end 12 of the capsule. It will be appreciated that such a second end wall may comprise exit openings and/or may be porous. Alternatively, such a second end wall may be fluid tight, e.g. in case the beverage preparation device is arranged for opening, such as by piercing, such a second end wall for allowing the beverage and/or liquid to exit the capsule.

For reference purposes in relation to body 1, a first direction X1 along said reference axis X is defined as being directed from the first end 11 towards the open second end 12, and a second direction X2 along said reference axis is defined as being opposite to the first direction X1.

The first end wall 3 comprises a portion 4 being deepened in the first direction X1. Thus, the deepened portion 4 is forming a first recessed space 5 on the second direction side of the first end wall 3. The first end wall 3 further comprises a projection 6 protruding from the deepened portion 4 into the first recessed space 5.

The cup-shaped body is formed such that identical specimens of it are slidable, along the reference axis X, into one another so as to form a stack of cup-shaped bodies. This can be seen in FIG. 2, where the situation is shown in which specimen 1 has already been slided into specimen 1A. The situation shown in FIG. 2 is the result of sliding specimen 1 in the second direction X2 and with its first end 11 in front through the open second end 12A of specimen 1A. Said slidability is allowed because of the fact that circumferential wall 2 widens in the first direction X1, i.e. narrows in the second direction X2.

The deepened portion 4 of the first end wall 11 is formed to comprise an abutment structure, shown as ribs 7, having an abutment condition in which the extent of said slidability of specimen 1 into specimen 1A is limited by abutment of the abutment structure (ribs 7A) of specimen 1A with the first end wall 3 of specimen 1, in such manner that in said abutment condition it is prevented that projection 6 of specimen 1 touches specimen 1A, even in case projection 6 protrudes in the second direction X2 as far as the farthermost point of the first end wall 3 of specimen 1.

However, as mentioned, in an alternative embodiment projection 6 may also touch the second specimen 1A in said abutment condition. Said touching may for example be in a bearing manner, in which case projection 6 functions as the abutment structure, or as part thereof. Alternatively, however, projection 6 may also just touch second specimen 1A without bearing second specimen 1A in said abutment condition.

In the shown example, said abutment structure comprises four ribs 7 providing said abutment, the four ribs 7 being situated on that side of the deepened portion 4 of the first end wall 3 that faces away from the first recessed space 5. In the shown example, each rib 7 has a longitudinal rib direction whose component projected along the reference axis X is very large. It has no component in circumferential direction C around the reference axis X, and its component in radial direction R relative to the reference axis X is very small. In the shown example, the four ribs 7 are equally spaced in circumferential direction C around the reference axis X.

In the situation of FIG. 2 the abutment structure, shown as ribs 7A, of specimen 1A is in its abutment condition. More specifically, the four ribs 7A of specimen 1A are in abutment with the first end wall 3 of specimen 1.

The deepened portion 4 of the first end wall 3 comprises a protruding part 8 protruding into the first direction X1. In FIG. 2 it is seen that the protruding part 8A of specimen 1A in the shown abutment condition of the four ribs 7 protrudes into the first recessed space 5 of specimen 1.

In FIG. 2 it is furthermore seen that in the shown abutment condition of the four ribs 7A the minimum radial distance between protruding part 8A of specimen 1A and the deepened portion 4 of the first end wall 3 of specimen 1 decreases when measuring said minimum radial distance farther in the second direction X2 along the reference axis X. The above-mentioned minimum radial distance at a considered location along the reference axis X is defined as taken in radial direction R relative to the reference axis X. In other words, in the range along the reference axis X where the protruding part 8A protrudes in the first recessed space 5, the outer (as seen in radial direction R) enveloping surface of the protruding part 8A is narrowing in the first direction X1 more strongly than the inner (as seen in radial direction R) enveloping surface in radial direction R of the deepened portion 4 is narrowing in the first direction X1. This promotes ease of bringing the protruding part 8A of specimen 1A into the first recessed space 5 of specimen 1. Thanks to this, accurate in-line placement of specimens 1 and 1A in the shown abutment condition is achieved automatically when the two specimens are being slided into each other.

In FIG. 2 it is furthermore seen that protruding part 8 is partly deepened in the second direction X2, thus forming a second recessed space 15 on the first direction side of the protruding part 8 in such manner that the projection 6 of specimen 1 in the shown abutment condition of the four ribs 7A of specimen 1A protrudes into the second recessed space 15A of specimen 1A.

In FIG. 2 it is furthermore seen that in the shown abutment condition of the four ribs 7A there also is abutment between circumferential wall 2 of specimen 1 and circumferential wall 2A of specimen 1A. This abutment of circumferential walls 2 and 2A is effective farther in the first direction X1 than where the abutment of the four ribs 7A is effective. In the shown example this abutment of said circumferential walls 2 and 2A is effective at the open second end 12A of specimen 1A, i.e. as far as possible away from where the abutment of the four ribs 7A is effective. In the shown example, this abutment of circumferential walls 2 and 2A is effective in four locations being angularly spaced relative to one another in circumferential direction C around the reference axis X. In the shown example, at each of these four locations the circumferential wall 2A of specimen 1A each time has a rib 9A at the inner surface of the circumferential wall 2A. This is also seen in FIG. 1, where the four identical ribs 9 of identical specimen 1 are shown. In the shown example, the four ribs 9 are equally spaced in the circumferential direction C, i.e. the angular spacing between two neighbouring ones of the four ribs 9 each time is 90 degrees.

It is remarked that it is not strictly necessary to apply ribs, such as the ribs 9, for achieving said abutment of the circumferential walls 2 and 2A. Alternatively, for achieving said abutment of the circumferential walls 2 and 2A, the circumferential wall 2 may be designed such that at a location along the reference axis X corresponding to the open second end 12 the inner diameter of the circumferential wall 2 is equal to the outer diameter of the circumferential wall 2 at a distance, in the second direction X2 along the reference axis X, which distance corresponds to the distance in which specimen 1 and specimen 1A are displaced relative to one another along the reference axis X in the abutment condition of the ribs 7A.

Figure 3:
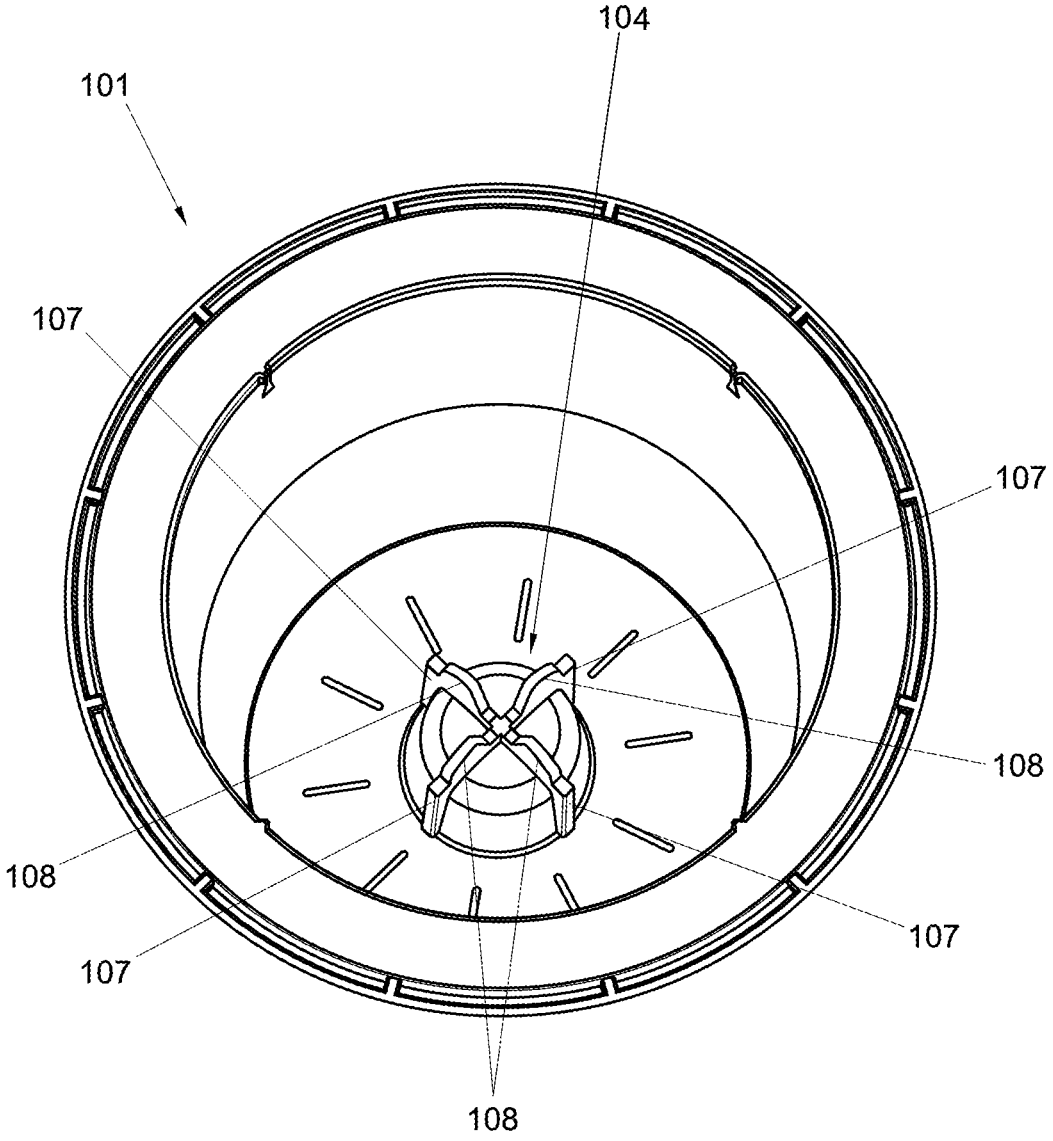
FIG. 3 shows, in a perspective view, a first specimen of a second embodiment of a cup-shaped body according to the invention.
Figure 4:
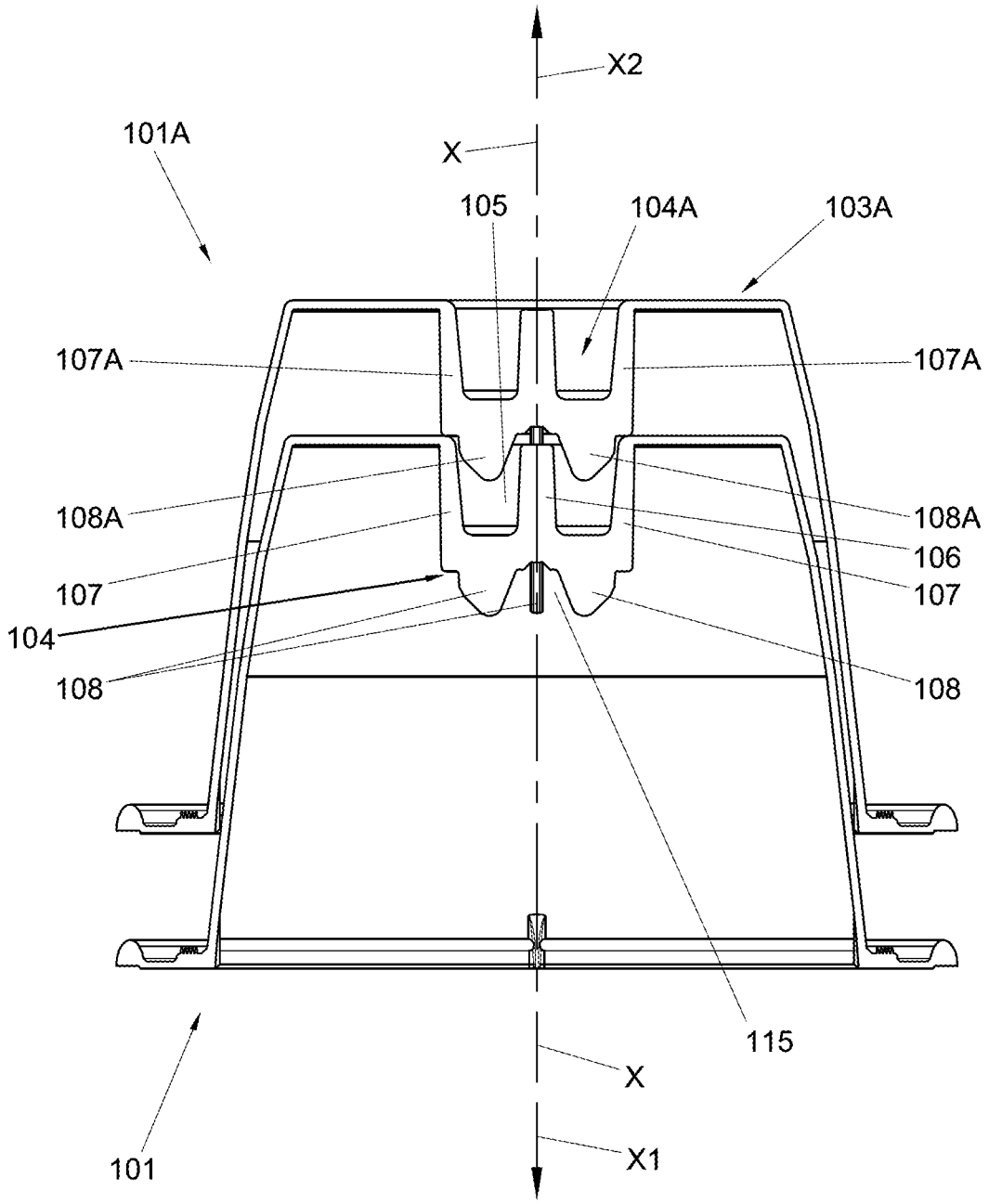
FIG. 4 shows the first specimen of FIG. 3 again, however this time in a cross-section (partly in through-view) and together with a second specimen being identical to the first specimen of FIG. 3, wherein the first specimen has been slided into the second specimen.

Next, reference is made to the second embodiment of FIGS. 3 and 4, which show a first specimen 101 and a second specimen 101A of that second embodiment. Hereinafter, specimen 101 and specimen 101A are also referred to as "body 101" and "body 101A", respectively. Parts of body 101 which are similar to parts of body 1 of FIGS. 1 and 2 have been indicated by the same reference numerals as used for body 1, be it that in each case the integer value 100 has been added to it. Specimen 101A is identical to specimen 101. Identical parts of body 101 and body 101A are indicated by identical reference numerals, be it that to each reference numeral of body 101A the suffix "A" has been appended. In FIG. 4, the shown reference axis X, the first direction X1 and the second direction X2, all used for reference purposes, are similar to those shown in FIG. 2.

The difference between the second embodiment of FIGS. 3 and 4 and the first embodiment of FIGS. 1 and 2 is that the protruding part 108 of the deepened portion 104 of body 101 is different from the protruding part 8 of the deepened portion 4 of body 1. That is, the protruding part 108 of the second embodiment is in the form of four protruding ribs 108, which are connected to the four abutment ribs 107, while the protruding part 8 of the first embodiment is a body of revolution around the reference axis X (i.e. rotationally symmetrical relative to the reference axis X). However, as can be seen from FIGS. 3 and 4, the features of the four protruding ribs 108 are such that the four protruding ribs 108 provide all the above-mentioned functions of the protruding part 8 of FIGS. 1 and 2.

Figure 5:
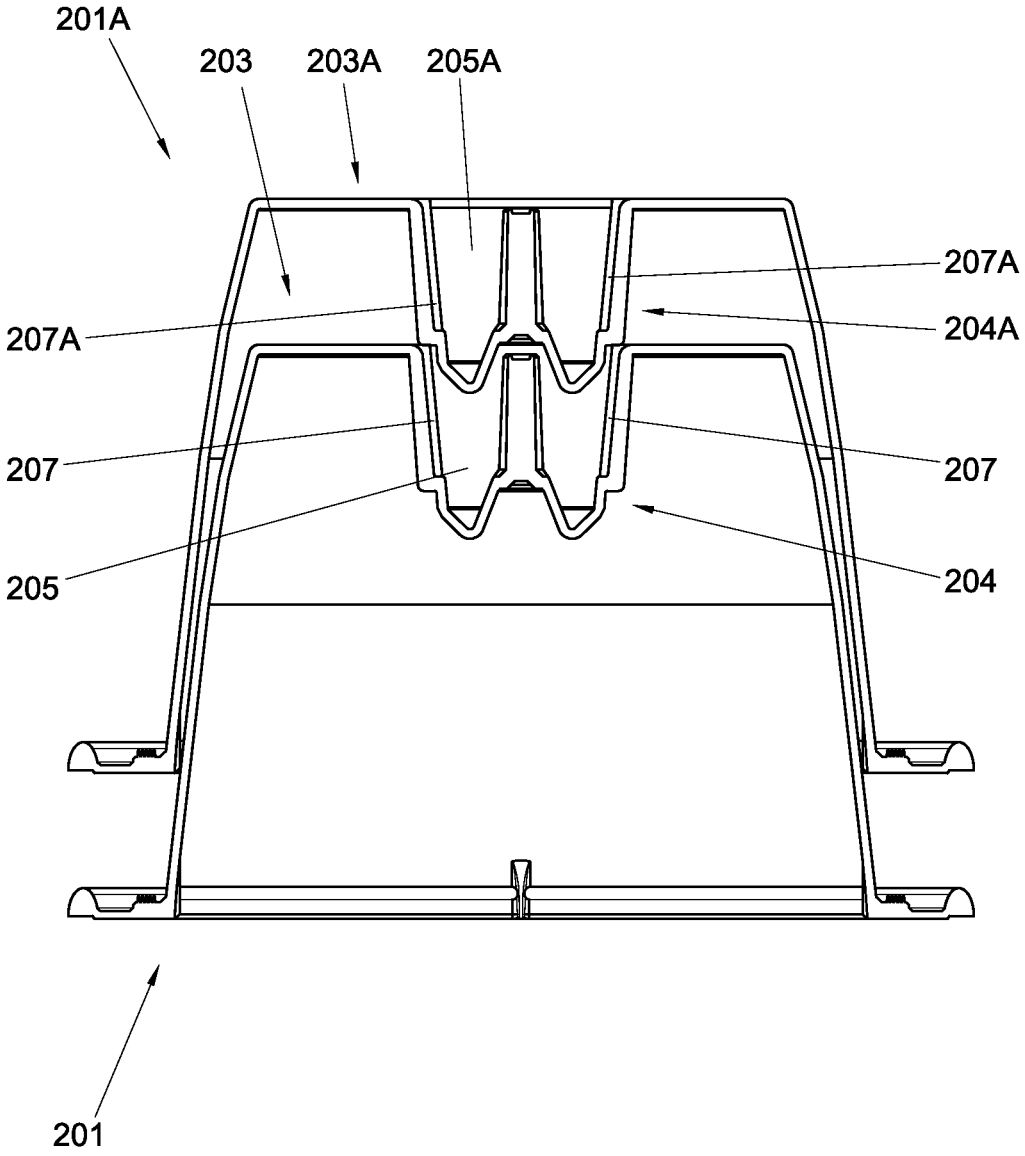
FIG. 5 shows, in a cross-section similar to that of FIGS. 2 and 4, a first specimen of a third embodiment of a cup-shaped body according to the invention together with a second specimen being identical to the first specimen, wherein the first specimen has been slided into the second specimen.

Next, reference is made to the third embodiment of FIG. 5, which shows a first specimen 201 and a second specimen 201A of that second embodiment. Hereinafter, specimen 201 and specimen 201A are also referred to as "body 201" and "body 201A", respectively. Parts of body 201 which are similar to parts of body 1 of FIGS. 1 and 2 have been indicated by the same reference numerals as used for body 1, be it that in each case the integer value 200 has been added to it. Specimen 201A is identical to specimen 201. Identical parts of body 201 and body 201A are indicated by identical reference numerals, be it that to each reference numeral of body 201A the suffix "A" has been appended.

The difference between the third embodiment of FIG. 5 and the first embodiment of FIGS. 1 and 2 is that in FIG. 5 the ribs 207 of the abutment structure that are providing said abutment are situated on that side of said deepened portion of the first end wall that faces towards said first recessed space.

Figure 6:
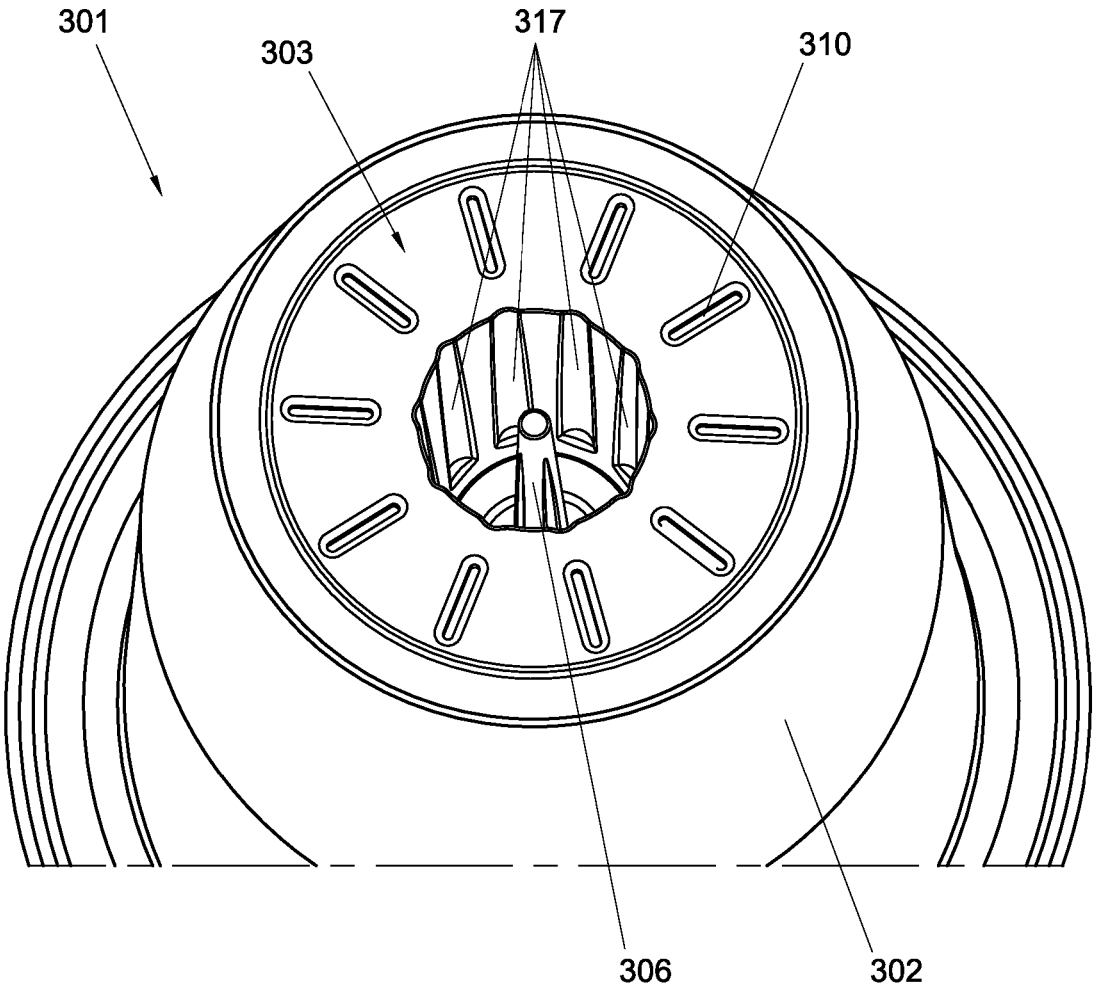
FIG. 6 shows, in a perspective view, a first specimen of a fourth embodiment of a cup-shaped body according to the invention.
Figure 7:
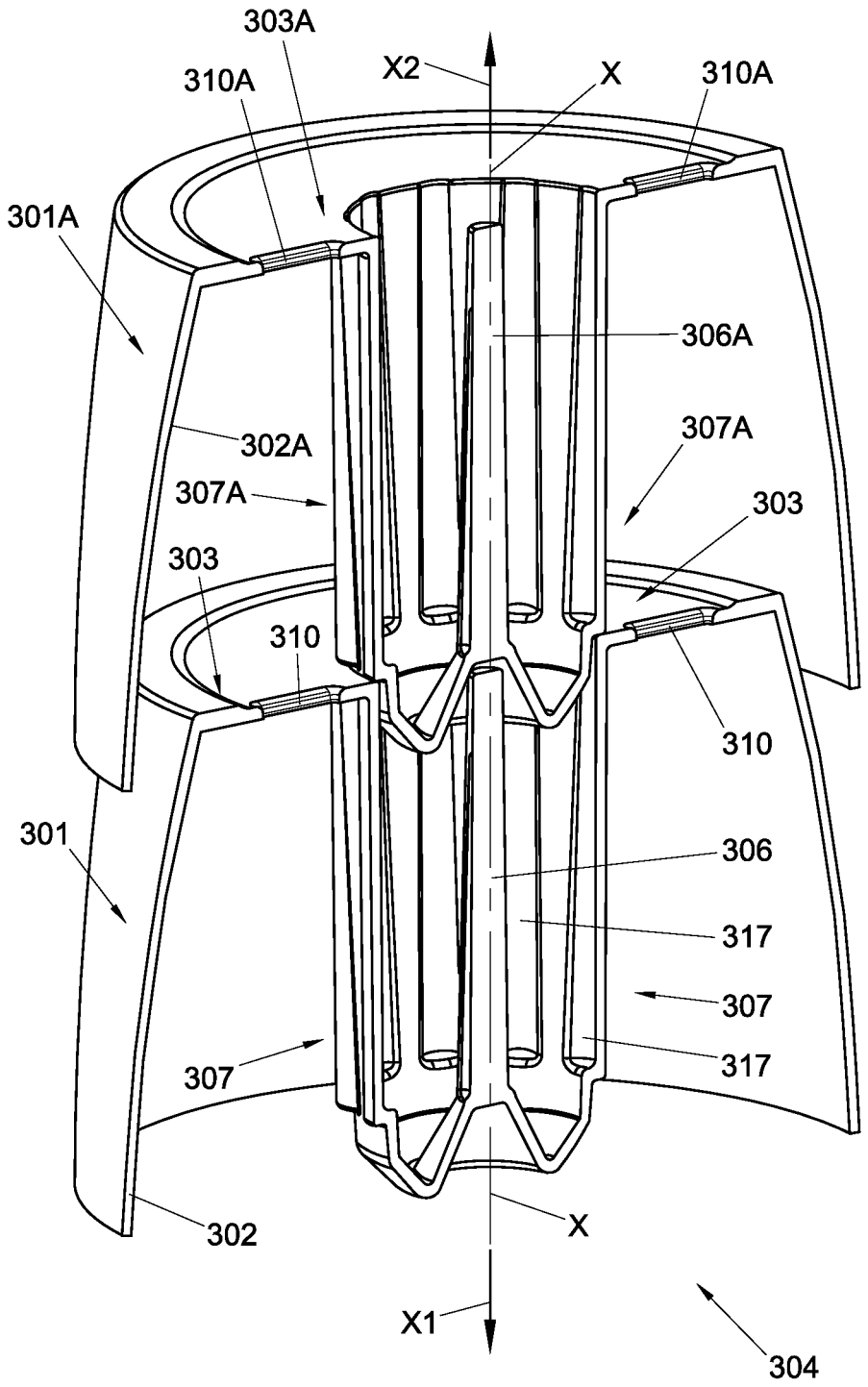
FIG. 7 shows part of the first specimen of FIG. 6 again, however this time in a perspective view onto a cross-section (partly in through-view) and together with part of a second specimen being identical to the first specimen of FIG. 6, wherein the first specimen has been slided into the second specimen.

Next, reference is made to the fourth embodiment of FIGS. 6 and 7, which show a first specimen 301 and, in FIG. 7, also a second specimen 301A of that fourth embodiment. Hereinafter, specimen 301 and specimen 301A are also referred to as "body 301" and "body 301A", respectively. Parts of body 301 which are similar to parts of body 1 of FIGS. 1 and 2 have been indicated by the same reference numerals as used for body 1, be it that in each case the integer value 300 has been added to it. Body 301A is identical to body 301. Identical parts of body 301 and body 301A are indicated by identical reference numerals, be it that to each reference numeral of body 301A the suffix "A" has been appended. In FIG. 7, the shown reference axis X, the first direction X1 and the second direction X2, all used for reference purposes, are similar to those shown in FIGS. 2 and 4.

The major difference between the fourth embodiment of FIGS. 6-7 and the previous embodiments of FIGS. 1-5 is, that in FIGS. 6-7 the abutment structure of body 301 comprises a rilled surface 307 of the deepened portion 304. Analogously, of course, the abutment structure of body 301A in FIG. 7 comprises a rilled surface 307A. In the abutment condition shown in FIG. 7, the extent of slidability of body 301 into body 301A (in the second direction X2) is limited by abutment of the rilled surface 307A of body 301A with the first end wall 303 of body 301. In the example of FIGS. 6-7, the rilled surface 307 is realized in that the circumferential wall of the deepened portion 304 has a number of bulging portions 317 which are bulging radially outwards (i.e. away from the reference axis X), thus forming longitudinal rills of said circumferential wall. (Note that rills are in fact present on both opposite sides of the circumferential wall, since what appears as a longitudinal bulge when looking at one side of a wall, appears as a rill at the opposite side, and vice versa). In the shown example, the longitudinal directions of the rills are substantially parallel to the reference axis X. This provides a stack of cup-shaped bodies with high resistance against forces occurring within the stack parallel to the reference axis. Furthermore, in the shown example, the rills are equally spaced in circumferential direction around the reference axis X. This provides a (large) stack of (many) cup-shaped bodies with high resistance against bending of the stack. In the shown example, the number of the equally spaced rills on a side of the circumferential wall is ten, but other numbers are of course possible as well. Futhermore, it is seen that the bulging portions 317 have been designed with bulging depths and with bulging widths, which both are increasing in the first direction X1. This provides favourable areas of abutment between the rilled surface 307A of body 301A and the first end wall 303 of body 301, which further promotes stability of a (large) stack of (many) cup-shaped bodies.

In the foregoing specification, the invention has been described with reference to specific examples of embodiments of the invention. However, various modifications and changes may be made therein without departing from the broader scope of the invention as set forth in the appended claims.

For instance, in the examples above, most parts of the shown cup-shaped bodies are rotationally symmetrical relative to the reference axis X. That is, the shown cup-shaped bodies are substantially bodies of revolution around the reference axis X (except for details like e.g. the slits 10, the ribs 7, 9 and 108, and rills of the rilled surface 307). However, various parts which have been shown in FIGS. 1-7 as bodies of revolution may also be not rotationally symmetrical relative to a reference axis, and may assume various other shapes.

Also, the first end wall of the cup-shaped body may comprise more than one deepened portion (with corresponding more than one recessed space) and/or may comprise more than one projection protruding from one such deepened portion into its corresponding recessed space.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to advantage.

What is claimed is:

1. A cup-shaped body for a capsule, the capsule containing an extractable product and being arranged for preparing a consumable beverage in a beverage preparation device, the cup-shaped body comprising:

a circumferential wall around a reference axis, a first end wall closing the circumferential wall at a first end of the cup-shaped body, and an open second end, opposite the first end;

wherein:

for reference purposes in relation to the cup-shaped body, a first direction along said reference axis is defined as being directed from the first end towards the open second end, and a second direction along said reference axis is defined as being opposite to the first direction, the first end wall comprises a portion being deepened in the first direction, said deepened portion thus forming a first recessed space on the second direction side of the first end wall, the first end wall comprises a projection protruding from said deepened portion into said first recessed space, the cup-shaped body is formed such that identical specimens of the cup-shaped body are slidable, along said reference axis, into one another so as to form a stack of said specimens, said slidability being such that a first specimen of said specimens can be slid in the second direction and with its first end in front through the open second end of a second specimen of said specimens and into said second specimen, and the deepened portion of the first end wall of the second specimen is formed to comprise an abutment structure having an abutment condition in which the extent of said slidability of said first specimen into said second specimen is limited by abutment of said abutment structure of said second specimen with the first end wall of said first specimen, wherein said abutment structure comprises at least one rib providing said abutment, the at least one rib being situated on a side of said deepened portion of the first end wall that faces away from said first recessed space.

2. The cup-shaped body according to claim 1, wherein in said abutment condition it is prevented that said projection of said first specimen touches said second specimen, even in case said projection protrudes in the second direction as far as the farthermost point of the first end wall of said first specimen.

3. The cup-shaped-body according to claim 1, wherein in said abutment condition said projection touches the second specimen.

4. The cup-shaped body according to claim 3, wherein in said abutment condition said projection just touches the second specimen without bearing said second specimen.

5. The cup-shaped body according to claim 1, wherein the deepened portion of the first end wall comprises a protruding part protruding into the first direction in such manner that the protruding part of the second specimen in said abutment condition protrudes into the first recessed space of the first specimen.

6. The cup-shaped body according to claim 5, further being arranged such that in said abutment condition the minimum radial distance between said protruding part of the second specimen and the deepened portion of the first end wall of the first specimen decreases when measuring said minimum radial distance farther in the second direction along the reference axis, said minimum radial distance at a considered location along the reference axis being defined as taken in radial direction relative to the reference axis.

7. The cup-shaped body according to claim 5, wherein the protruding part is partly deepened in the second direction, thus forming a second recessed space on the first direction side of the protruding part in such manner that the projection of the first specimen in said abutment condition protrudes into the second recessed space of the second specimen.

8. The cup-shaped body according to claim 1, further being arranged such that in said abutment condition of said abutment structure there also is abutment between the circumferential wall of said first specimen and the circumferential wall of said second specimen, said abutment of said circumferential walls being effective:

farther in the first direction than where the abutment of said abutment structure is effective, most preferably as far as possible away from where the abutment of said abutment structure is effective, and in at least three locations being angularly spaced relative to one another in circumferential direction around the reference axis, said angular spacing being such that in each of three complementary 120 degrees circumferential sectors around the reference axis there exists at least one of said at least three locations.

9. A cup-shaped body for a capsule, the capsule containing an extractable product and being arranged for preparing a consumable beverage in a beverage preparation device, the cup-shaped body comprising:

a circumferential wall around a reference axis;

a first end wall closing the circumferential wall at a first end of the cup-shaped body; and an open second end, opposite the first end;

wherein:

for reference purposes in relation to the cup-shaped body, a first direction along said reference axis is defined as being directed from the first end towards the open second end, and a second direction along said reference axis is defined as being opposite to the first direction;

the first end wall comprises a portion being deepened in the first direction, said deepened portion thus forming a first recessed space on the second direction side of the first end wall;

the first end wall comprises a projection protruding from said deepened portion into said first recessed space;

the cup-shaped body is formed such that identical specimens of the cup-shaped body are slidable along said reference axis into one another so as to form a stack of said specimens, said slidability being such that a first specimen of said specimens can be slid in the second direction and with its first end in front through the open second end of a second specimen of said specimens and into said second specimen; and the deepened portion of the first end wall of the second specimen is formed to comprise an abutment structure having an abutment condition in which the extent of said slidability of said first specimen into said second specimen is limited by abutment of said abutment structure of said second specimen with the first end wall of said first specimen, wherein said abutment structure comprises at least one rib providing said abutment, the at least one rib being situated on a side of said deepened portion of the first end wall that faces towards said first recessed space and spaced apart from the projection.

10. The cup-shaped body according to claim 9, wherein in said abutment condition it is prevented that said projection of said first specimen touches said second specimen, even in case said projection protrudes in the second direction as far as the farthermost point of the first end wall of said first specimen.

11. The cup-shaped body according to claim 9, wherein in said abutment condition said projection touches the second specimen.

12. The cup-shaped body according to claim 9, wherein the deepened portion of the first end wall comprises a protruding part protruding into the first direction in such manner that the protruding part of the second specimen in said abutment condition protrudes into the first recessed space of the first specimen.

13. The cup-shaped body according to claim 9, further being arranged such that in said abutment condition of said abutment structure there also is abutment between the circumferential wall of said first specimen and the circumferential wall of said second specimen, said abutment of said circumferential walls being effective:

farther in the first direction than where the abutment of said abutment structure is effective, most preferably as far as possible away from where the abutment of said abutment structure is effective, and in at least three locations being angularly spaced relative to one another in circumferential direction around the reference axis, said angular spacing being such that in each of three complementary 120 degrees circumferential sectors around the reference axis there exists at least one of said at least three locations.

14. A cup-shaped body for a capsule, the capsule containing an extractable product and being arranged for preparing a consumable beverage in a beverage preparation device, the cup-shaped body comprising:

a circumferential wall around a reference axis;

a first end wall closing the circumferential wall at a first end of the cup-shaped body; and an open second end, opposite the first end;

wherein:

for reference purposes in relation to the cup-shaped body, a first direction along said reference axis is defined as being directed from the first end towards the open second end, and a second direction along said reference axis is defined as being opposite to the first direction;

the first end wall comprises a portion being deepened in the first direction, said deepened portion thus forming a first recessed space on the second direction side of the first end wall;

the first end wall comprises a projection protruding from said deepened portion into said first recessed space;

the cup-shaped body is formed such that identical specimens of the cup-shaped body are slidable, along said reference axis, into one another so as to form a stack of said specimens, said slidability being such that a first specimen of said specimens can be slid in the second direction and with its first end in front through the open second end of a second specimen of said specimens and into said second specimen; and the deepened portion of the first end wall of the second specimen is formed to comprise an abutment structure having an abutment condition in which the extent of said slidability of said first specimen into said second specimen is limited by abutment of said abutment structure of said second specimen with the first end wall of said first specimen, wherein said abutment structure comprises a rilled surface formed by bulging portions of said deepened portion, said rilled surface providing said abutment, wherein in said abutment condition said projection touches the second specimen.

15. A cup-shaped body for a capsule, the capsule containing an extractable product and being arranged for preparing a consumable beverage in a beverage preparation device, the cup-shaped body comprising:

a circumferential wall around a reference axis;

a first end wall closing the circumferential wall at a first end of the cup-shaped body; and an open second end, opposite the first end;

wherein for reference purposes in relation to the cup-shaped body, a first direction along said reference axis is defined as being directed from the first end towards the open second end, and a second direction along said reference axis is defined as being opposite to the first direction;

wherein the first end wall comprises a portion being deepened in the first direction, said deepened portion thus forming a first recessed space on the second direction side of the first end wall;

wherein the first end wall comprises a projection protruding from said deepened portion into said first recessed space;

wherein the cup-shaped body is formed such that identical specimens of the cup-shaped body are slidable, along said reference axis, into one another so as to form a stack of said specimens, said slidability being such that a first specimen of said specimens can be slid in the second direction and with its first end in front through the open second end of a second specimen of said specimens and into said second specimen; and wherein the deepened portion of the first end wall of the second specimen is formed to comprise an abutment structure having an abutment condition in which the extent of said slidability of said first specimen into said second specimen is limited by abutment of said abutment structure of said second specimen with the first end wall of said first specimen, wherein said abutment structure comprises a rilled surface formed by bulging portions of said deepened portion, said rilled surface providing said abutment, further being arranged such that in said abutment condition of said abutment structure there also is abutment between the circumferential wall of said first specimen and the circumferential wall of said second specimen, said abutment of said circumferential walls being effective:

farther in the first direction than where the abutment of said abutment structure is effective, most preferably as far as possible away from where the abutment of said abutment structure is effective, and in at least three locations being angularly spaced relative to one another in circumferential direction around the reference axis, said angular spacing being such that in each of three complementary 120 degrees circumferential sectors around the reference axis there exists at least one of said at least three locations.

* * * * *